US009717394B2

(12) United States Patent
DeSimone

(10) Patent No.: US 9,717,394 B2
(45) Date of Patent: Aug. 1, 2017

(54) LINT ROLLER COVER

(71) Applicant: Helen Ann DeSimone, Little Falls, NJ (US)

(72) Inventor: Helen Ann DeSimone, Little Falls, NJ (US)

( * ) Notice: Subject to any disclaimer, the term of this patent is extended or adjusted under 35 U.S.C. 154(b) by 6 days.

(21) Appl. No.: 14/626,554

(22) Filed: Feb. 19, 2015

(65) Prior Publication Data

US 2016/0242622 A1 Aug. 25, 2016

(51) Int. Cl.
*A47L 25/00* (2006.01)

(52) U.S. Cl.
CPC ..... *A47L 25/005* (2013.01)

(58) Field of Classification Search
CPC ..... A47L 25/005; B65D 75/04
USPC ..... 15/247; 150/154; 206/410, 398.447, 446
See application file for complete search history.

(56) References Cited

U.S. PATENT DOCUMENTS 1,068,066 A * 7/1913 Martin ..... B65D 81/3886 150/154
1,710,598 A * 4/1929 Wasserman ..... B65D 75/02 15/247
2,301,586 A * 11/1942 Rubin ..... A47L 13/29 15/147.2
2,346,908 A * 4/1944 Corley ..... B43L 1/08 206/410
2,724,847 A * 11/1955 Krasno ..... A47L 25/005 15/104.002
2,732,063 A * 1/1956 Dedek et al. ..... B65D 65/10 206/410
3,082,453 A * 3/1963 Mutchler ..... A47L 25/005 138/141
RE25,675 E * 11/1964 Neal ..... A47L 13/18 15/104.002
3,421,170 A * 1/1969 Thomas, Jr. ..... A47L 25/005 15/104.002
4,606,456 A * 8/1986 Kaminski ..... B65D 75/14 206/362.3
4,876,841 A * 10/1989 Jensen ..... B65D 71/0096 108/55.1
5,226,544 A * 7/1993 Gallucci ..... B65D 19/38 150/154
6,142,966 A * 11/2000 Hely ..... A61F 13/108 128/879
7,188,384 B2 3/2007 McKay
D596,044 S * 7/2009 Goldman ..... D9/734
2004/0194240 A1 10/2004 McKay, Jr.
2005/0160550 A1* 7/2005 Reeves ..... A46B 11/06 15/247

(Continued)

FOREIGN PATENT DOCUMENTS

GB 1064745 * 4/1967

*Primary Examiner* — Sue A Weaver
(74) *Attorney, Agent, or Firm* — Charney IP Law LLC

(57) ABSTRACT

A lint remover cover is provided. The cover is a substantially flat and bendable sheet having a first end, a second end, an upper surface, a lower surface, and an edge about the perimeter. A strap is attached to the upper surface and protrudes past the edge on the first end. A connector is attached to the upper surface near the second end and releasably attaches to the strap. The cover is wrapped around a lint roller covering the adhesive tape. The strap connects to the connector to further secure the cover to the lint roller.

10 Claims, 3 Drawing Sheets

(56) References Cited

U.S. PATENT DOCUMENTS

| | | | | |
|---|---|---|---|---|
| 2005/0235446 | A1* | 10/2005 | Eggers | A47L 11/162 15/220.1 |
| 2007/0022550 | A1* | 2/2007 | McLeod | A47L 25/005 15/104.002 |
| 2008/0110780 | A1* | 5/2008 | Hogg | B65D 75/08 206/410 |
| 2009/0008005 | A1* | 1/2009 | Chu | A01K 1/03 150/154 |
| 2009/0162596 | A1* | 6/2009 | Rios | A43B 13/04 428/45 |
| 2009/0255073 | A1* | 10/2009 | Emmons | A47L 25/005 15/104.002 |
| 2011/0005647 | A1* | 1/2011 | Campfield | B65D 65/10 150/154 |
| 2012/0284939 | A1 | 11/2012 | Anderson | |
| 2016/0143508 | A1* | 5/2016 | McGrath | A47L 25/005 15/104.002 |

* cited by examiner

FIG.1
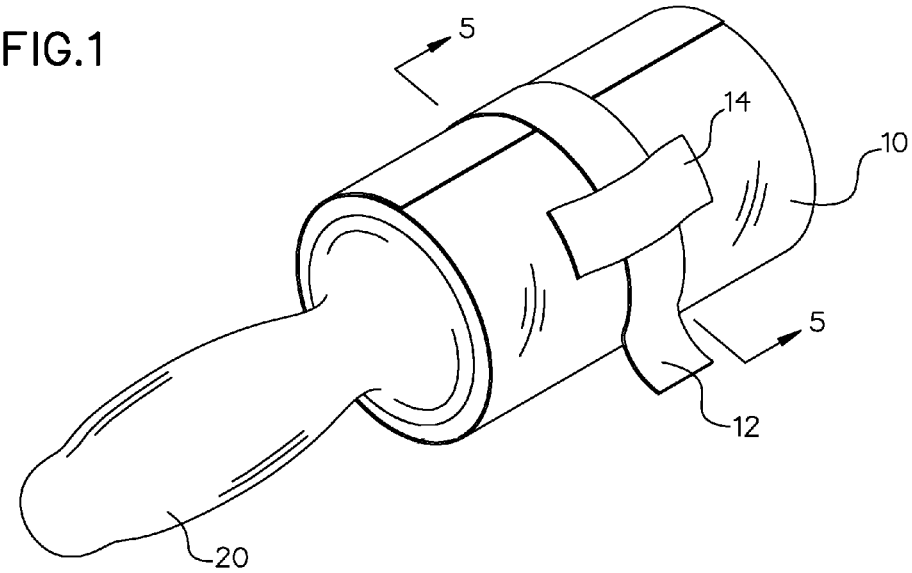
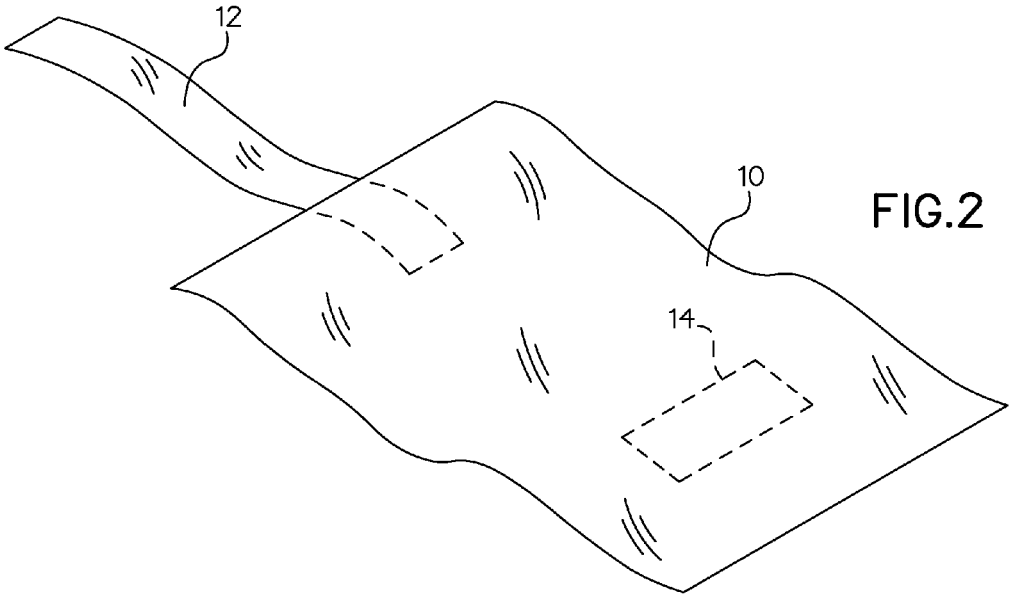
FIG.2

FIG.3
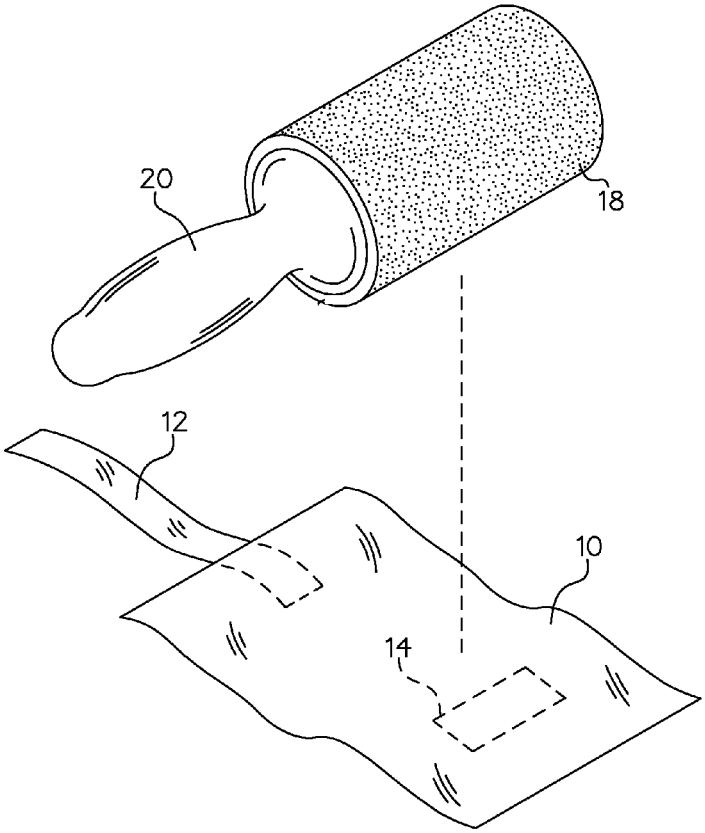
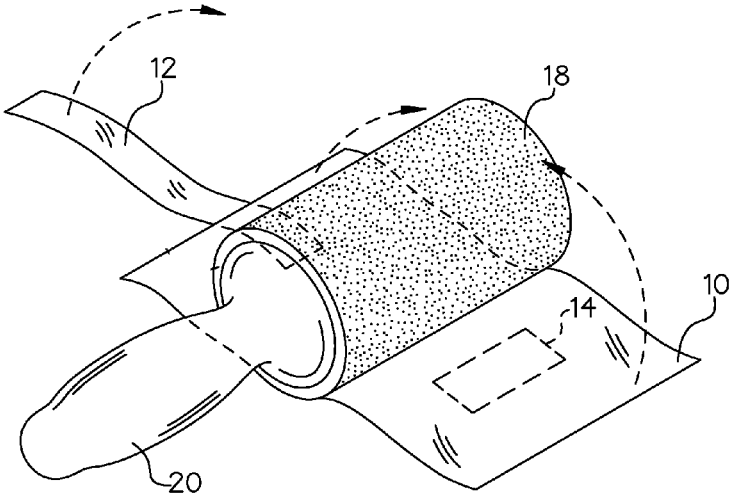
FIG.4

LINT ROLLER COVER

BACKGROUND OF THE INVENTION

The present invention relates to lint rollers and, more particularly, to a lint roller cover.

A lint roller or lint remover is a roll of one-sided adhesive paper on a cardboard or plastic barrel that is mounted on a central spindle, with an attached handle. The device facilitates the removal of lint or other small fibers from most materials such as clothing, upholstery and linen. Once expended, the roll can typically be replaced with a "refill" roll. When storing a lint roller, debris tends to stick on the new adhesive sheet. Therefore, when the user is ready to use the lint roller, a new sheet must be wasted.

As can be seen, there is a need for a cover for the lint roller that is quick, easy to use and inexpensive.

SUMMARY OF THE INVENTION

In one aspect of the present invention, a lint remover cover comprises: a substantially flat sheet having a first end, a second end, an upper surface, a lower surface, and an edge about the perimeter; a strap attached to the upper surface, and protruding past the edge on the first end; and a connector attached to the upper surface near the second end and releasably attachable to the strap.

In another aspect of the present invention, a method of covering a lint remover comprises: providing a cover comprising: a substantially flat sheet having a first end, a second end, an upper surface, a lower surface, and an edge about the perimeter; a strap attached to the upper surface, and protruding past the edge on the first end; and a connector attached to the upper surface near the second end; wrapping the cover around a lint roller so that the lower surface is facing towards an adhesive tape of the lint roller; attaching the strap to the connector, thereby securing the cover on the lint roller.

These and other features, aspects and advantages of the present invention will become better understood with reference to the following drawings, description and claims.

BRIEF DESCRIPTION OF THE DRAWINGS

FIG. 1 is a perspective view of an embodiment of the present invention shown in use;

FIG. 2 is a perspective view of an embodiment of the present invention;

FIG. 3 is an exploded view of an embodiment of the present invention;

FIG. 4 is a perspective view illustrating the application of the present invention;

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a protective covering for adhesive type lint removers. This silicone or plastic cover protects the adhesive lint removal sheet by covering it when not in use. The connector of the present invention allows the barrier to be secured around the adhesive portion of the lint remover and protect the lint roller. The silicone or plastic barrier is wrapped around the adhesive portion of the lint roller and is then secured in place with the connector.

Figure 5:
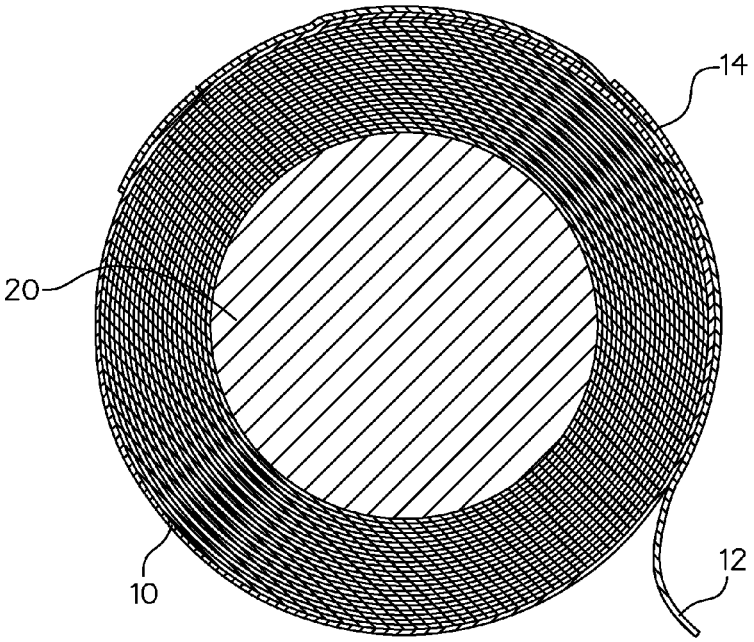
FIG. 5 is a section view taken from 5-5 of FIG. 1.
Figure 6:
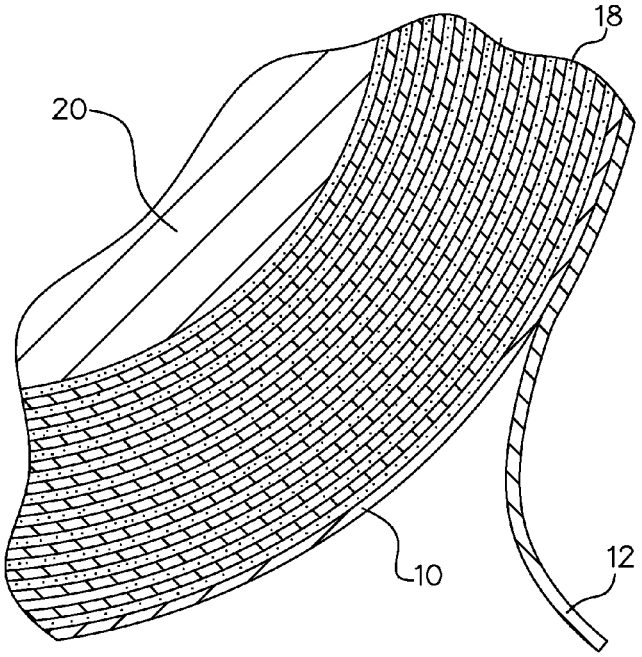
FIG. 6 is an enlarged section view of the present invention.

Referring to FIGS. 1 through 6, the present invention includes a lint remover cover 10. The cover 10 is a substantially flat and bendable sheet having a first end, a second end, an upper surface, a lower surface, and an edge about the perimeter. A strap 12 is attached to the upper surface and protrudes past the edge on the first end. A connector 14 is attached to the upper surface near the second end and releasably attaches to the strap 12. The cover 10 is wrapped around a lint roller 20 covering the adhesive tape 18. The strap 12 connects to the connector 14 to further secure the cover 10 to the lint roller 20.

The cover 10 may be made of silicone or other polymer, such as bendable plastics. In certain embodiments, the connector 14 includes a first end and a second end each attached to the upper surface and forming a loop in between. The strap 12 fits within the loop to releasably attach to the connector 14. The connector 14 is substantially perpendicular to the strap 12 so that the opening of the loop is able to easily receive the strap 12 once the cover 10 has been wrapped around the adhesive tape 18.

A method of covering a lint roller 20 may include the following. The cover 10 mentioned above is provided. The cover 10 is wrapped around the lint roller so that the lower surface of the cover 10 is facing towards the adhesive tape 18 of the lint roller 20. The strap 12 is then attached to the connector 14 by inserting the strap 12 into the loop.

It should be understood, of course, that the foregoing relates to exemplary embodiments of the invention and that modifications may be made without departing from the spirit and scope of the invention as set forth in the following claims.

What is claimed is:

1. A lint roller cover for protecting an exposed adhesive portion of a lint roller, said cover comprising:

a substantially flat sheet having a first end, a second end, an upper surface, a lower surface, and an edge about the perimeter;

a strap attached to the upper surface, and protruding past the edge on the first end; and a connector attached to the upper surface near the second end and releasably attachable to the strap;

wherein said lint roller cover may be wrapped around the exposed adhesive portion of the lint roller with said lower surface of said lint roller cover abutting and protecting the exposed adhesive portion of the lint roller.

2. The lint roller cover of claim 1, wherein the substantially flat sheet is made of silicone.

3. The lint roller cover of claim 1, wherein the connector comprises a first end and a second end each attached to the upper surface and forming a loop in between, wherein the strap fits within the loop to releasably attach.

4. The lint roller cover of claim 3, wherein the connector is substantially perpendicular to the strap.

5. The lint roller cover of claim 1, wherein said connector may be releasably attached to said strap when said lint roller cover is wrapped around the exposed adhesive portion of the lint roller.

6. The lint roller cover of claim 1, wherein said lint roller is cylindrical and said lint roller cover is rectangular.

7. A method of covering a lint roller comprising:

providing a cover comprising:

a substantially flat sheet having a first end, a second end, an upper surface, a lower surface, and an edge about the perimeter;

a strap attached to the upper surface, and protruding past the edge on the first end; and a connector attached to the upper surface near the second end;

wrapping the cover around the lint roller so that the lower surface is facing towards an adhesive tape of the lint roller to protect the adhesive tape;

attaching the strap to the connector, thereby securing the cover on the lint roller.

8. The method of claim 7, wherein the connector comprises a first end and a second end each attached to the upper surface and forming a loop in between.

9. The method of claim 8, wherein the step of attaching the strap to the connector comprises:

inserting the strap into the loop of the connector.

10. The method of claim 7, wherein the substantially flat sheet is made of silicone.

* * * * *